US009322564B2

(12) United States Patent
Kanbara

(10) Patent No.: US 9,322,564 B2
(45) Date of Patent: Apr. 26, 2016

(54) REFRIGERATION MANAGING APPARATUS

(75) Inventor: Osamu Kanbara, Moriguchi (JP)

(73) Assignee: PANASONIC INTELLECTUAL PROPERTY MANAGEMENT CO., LTD., Osaka-shi (JP)

( * ) Notice: Subject to any disclaimer, the term of this patent is extended or adjusted under 35 U.S.C. 154(b) by 694 days.

(21) Appl. No.: 13/408,369

(22) Filed: Feb. 29, 2012

(65) Prior Publication Data

US 2012/0216556 A1 Aug. 30, 2012

Related U.S. Application Data

(63) Continuation of application No. PCT/JP2010/064597, filed on Aug. 27, 2010.

(30) Foreign Application Priority Data

Aug. 31, 2009 (JP) ..... 2009-200585
Jul. 30, 2010 (JP) ..... 2010-171483

(51) Int. Cl.
*F25B 49/00* (2006.01)
*F25D 21/02* (2006.01)
(Continued)

(52) U.S. Cl.
CPC ..... *F24F 11/006* (2013.01); *F24F 11/0086* (2013.01); *F25B 49/02* (2013.01);
(Continued)

(58) Field of Classification Search
CPC ..... F24F 11/006; F24F 2011/0061; F24F 2011/0063; F24F 2011/0064; F24F 11/0086; F24F 2011/0045; F25B 49/02; F25B 49/022; F25B 2400/22; F25B 2700/2117; F25B 5/02; F25B 2313/0233; F25B 2313/025; F25B 2313/0253
USPC ..... 62/125, 129, 246, 252
See application file for complete search history.

(56) References Cited

U.S. PATENT DOCUMENTS 5,383,336 A 1/1995 Nishida et al.
5,499,510 A 3/1996 Yoshida et al.

FOREIGN PATENT DOCUMENTS

JP 6-147605 A 5/1994
JP 7-71809 A 3/1995
(Continued)

OTHER PUBLICATIONS

International Search Report of PCT/JP2010/064597, mailing date of Nov. 2, 2010.

*Primary Examiner* — Mohammad M Ali
*Assistant Examiner* — Daniel C Comings
(74) *Attorney, Agent, or Firm* — Westerman, Hattori, Daniels & Adrian, LLP

(57) ABSTRACT

A refrigeration managing apparatus that can reduce the time taken to determine refrigerant piping groups which connect refrigerant supply devices and cooling devices is provided. When determining cooling devices connected to refrigerant supply devices using refrigerant pipes, the refrigeration managing apparatus detects changes in the temperatures of evaporators of the cooling devices when the refrigerant supply devices are operated/stopped in accordance with change patterns which are stored in advance, which are determined on the basis of the number of refrigerant supply devices, and in which the states of the refrigerant supply devices are changed with time by being switched between an in-operation state and a stopped state. The refrigeration managing apparatus determines that, among the cooling devices, a cooling device having the evaporator whose temperature changes in synchronization with the in-operation/stopped state of a refrigerant supply device among the refrigerant supply devices is connected to the refrigerant supply device.

7 Claims, 10 Drawing Sheets

(51) Int. Cl.

| | |
|---|---|
| ***G01K 13/00*** | (2006.01) |
| ***A47K 3/04*** | (2006.01) |
| ***F24F 11/00*** | (2006.01) |
| ***F25B 49/02*** | (2006.01) |

(52) U.S. Cl.

CPC ..... *F25B 49/022* (2013.01); *F24F 2011/0045* (2013.01); *F24F 2011/0061* (2013.01); *F24F 2011/0063* (2013.01); *F24F 2011/0064* (2013.01); *F24F 2011/0067* (2013.01); *F24F 2011/0068* (2013.01); *F25B 2400/22* (2013.01); *F25B 2700/2117* (2013.01); *F25D 2700/12* (2013.01)

(56) References Cited

FOREIGN PATENT DOCUMENTS

| | | | | | |
|---|---|---|---|---|---|
| JP | 7-91718 | A | | 4/1995 | |
| JP | 2006-214689 | A | * | 8/2006 | ..... F24F 11/02 |
| JP | 2009-14280 | A | | 1/2009 | |

* cited by examiner

FIG. 9A

| | FIRST ATTEMPT | SECOND ATTEMPT | THIRD ATTEMPT |
|---|---|---|---|
| REFRIGERANT SUPPLY DEVICE 12J | 1 | 1 | 1 |
| REFRIGERANT SUPPLY DEVICE 12K | 1 | 1 | 0 |
| REFRIGERANT SUPPLY DEVICE 12L | 1 | 0 | 0 |
| REFRIGERANT SUPPLY DEVICE 12M | 0 | 1 | 0 |
| REFRIGERANT SUPPLY DEVICE 12N | 0 | 0 | 1 |

FIG. 9B

| | FIRST ATTEMPT | SECOND ATTEMPT |
|---|---|---|
| REFRIGERANT SUPPLY DEVICE 12J | 1 | 1 |
| REFRIGERANT SUPPLY DEVICE 12K | 1 | 0 |
| REFRIGERANT SUPPLY DEVICE 12L | 0 | 1 |

FIG. 9C

| | FIRST ATTEMPT | SECOND ATTEMPT | THIRD ATTEMPT |
|---|---|---|---|
| REFRIGERANT SUPPLY DEVICE 12J | 1 | 1 | 1 |
| REFRIGERANT SUPPLY DEVICE 12K | 1 | 1 | 0 |
| REFRIGERANT SUPPLY DEVICE 12L | 1 | 0 | 0 |
| REFRIGERANT SUPPLY DEVICE 12M | 0 | 1 | 0 |

FIG. 11A

| | FIRST ATTEMPT | SECOND ATTEMPT |
|---|---|---|
| REFRIGERANT SUPPLY DEVICE 12J | 1 | 1 |
| REFRIGERANT SUPPLY DEVICE 12K | 1 | 0 |
| REFRIGERANT SUPPLY DEVICE 12L | 0 | 1 |

FIG. 11B

| | FIRST ATTEMPT | SECOND ATTEMPT |
|---|---|---|
| REFRIGERANT SUPPLY DEVICE 12M | 1 | 0 |
| REFRIGERANT SUPPLY DEVICE 12N | 0 | 1 |

REFRIGERATION MANAGING APPARATUS

CROSS-REFERENCE TO RELATED APPLICATIONS

This application is a Continuation of PCT/JP2010/064597, filed on Aug. 27, 2010, claiming priority based on Japanese Applications No. 2009-200585 filed on Aug. 31, 2009, and No. 2010-171483 filed on Jul. 30, 2010, the contents of which are incorporated herein by reference in their entirety.

BACKGROUND

1. Field

The present disclosure relates to refrigeration managing apparatuses for controlling multiple cooling devices, such as showcases, refrigerators, freezers, or air conditioners, that are installed in a store such as a supermarket and that have refrigeration cycles, and for controlling multiple refrigerant supply devices that supply refrigerants to the multiple cooling devices.

2. Description of the Related Art

In a store such as a supermarket, operation states of multiple cooling devices, such as showcases or air conditioners, that are installed in the store and that have refrigeration cycles are centrally controlled by a refrigeration managing apparatus. In recent years, it has been considered that, by effectively controlling devices (hereinafter, collectively referred to as "equipment") that consume electric power, such as the cooling devices and refrigerant supply devices, the power consumption of the equipment is reduced.

For this reason, development of refrigeration managing apparatuses and cooling systems has started. The refrigeration managing apparatuses are also referred to as integration controllers that integrally manage pieces of equipment. In the cooling systems, the individual pieces of equipment are connected to each other using communication lines, and an integration controller integrally performs control on the pieces of equipment via the communication lines while sections of the control corresponding to the individual pieces of equipment are being performed in cooperation with one another.

Note that, typically, one refrigerant piping group is formed, in which one cooling device or multiple cooling devices are connected in parallel to one refrigerant supply device via a refrigerant pipe. More specifically, one refrigeration cycle is formed by connecting a refrigerant compressor of a refrigerant supply device, a condenser, a decompressor, an evaporator of at least one cooling device in a loop. One refrigerant piping group is formed so as to have the one refrigeration cycle. Multiple refrigerant piping groups may exist. A refrigerant output from the refrigerant supply device flows through the refrigerant pipe, and then supplied to each of the cooling devices.

The cooling device has at least an evaporator therein. For example, in a case of refrigeration equipment, a chilling showcase, a freezing showcase (hereinafter, which are collectively referred to as "showcases"), or the like serves as the cooling device. Furthermore, for example, in a case of air conditioning equipment, an inside unit or the like serves as the cooling device. The refrigerant supply device is a device having a refrigerant compressor that compresses a refrigerant, a condenser, a decompressor, and so forth therein. For example, in the case of refrigeration equipment, a freezing device or the like serves as the refrigerant supply device. Moreover, for example, in the case of air conditioning equipment, an outdoor unit or the like serves as the refrigerant supply device.

As an example of control that is performed in order to reduce the power consumption of equipment, for each refrigerant piping group, an integration controller of a cooling system detects the operation state of one cooling device or the operation states of multiple cooling devices, and controls one refrigerant supply device as necessary. However, in order to perform the above-mentioned control, it is necessary to determine the one cooling device or the multiple cooling devices and the one refrigerant supply device in each refrigerant piping group.

For example, in Japanese Unexamined Patent Application Publication No. 2006-214689, a technique is disclosed, in which outdoor units that are refrigerant supply devices are activated on a one-by-one basis, and in which refrigerant piping groups are determined on the basis of changes in data measured in individual indoor units. Furthermore, in Japanese Unexamined Patent Application Publication No. 2009-14280, a technique is disclosed, in which, first, all outdoor units are activated, in which, then, the outdoor units are stopped on a one-by-one basis, and in which refrigerant piping groups are determined on the basis of changes in data measured in individual indoor units.

In recent years, the size of stores tends to increase, and the number of pieces of refrigeration equipment increases with increasing size of stores. Accordingly, when a technique in which refrigerant piping groups are determined by operating refrigerant supply devices on a one-by-one basis as described in Japanese Unexamined Patent Application Publication No. 2006-214689 and No. 2009-14280 is used, the number of refrigerant piping groups increases with increasing number of refrigerant supply devices. Accordingly, the time taken to determine the refrigerant piping groups increases.

SUMMARY

Accordingly, it is an object of the present disclosure to provide a refrigeration managing apparatus that can reduce the time taken to determine refrigerant piping groups.

In order to achieve the above-mentioned object, a refrigeration managing apparatus according to the present disclosure is an apparatus for controlling operation of refrigeration cycles of refrigerant piping groups installed in a single store, and for determining connection relationships of refrigerant pipes connected between refrigerant supply devices and cooling devices included in the refrigerant piping groups. Each of the refrigerant piping groups includes at least one cooling device that has an evaporator and that cools a subject to be cooled, and a refrigerant supply device that has a refrigerant compressor and that supplies a refrigerant to the at least one cooling device. Each of the refrigeration cycles is formed for a corresponding one of the refrigerant piping groups by connecting the refrigerant compressor of the refrigerant supply device, a condenser, a decompressor, and the evaporator of the at least one cooling device in a loop using a refrigerant pipe. The refrigeration managing apparatus according to the present disclosure includes a storage section and a controller. The storage section stores change patterns which are determined on the basis of the number of refrigerant supply devices and in which states of the refrigerant supply devices are changed with time by being switched between an in-operation state and a stopped state. The controller detects changes in temperatures of the evaporators of the cooling devices when the refrigerant supply devices are operated/stopped in accordance with the change patterns stored in the storage section, and determines that, among the cooling devices, a cooling device having the evaporator whose temperature changes in synchronization with the in-operation/ stopped state of a refrigerant supply device among the refrigerant supply devices is connected to the refrigerant supply device using the corresponding refrigerant pipe.

In the refrigeration managing apparatus according to the present invention, in a case of determining the cooling devices connected to the refrigerant supply devices using the refrigerant pipes, changes in the temperatures of the evaporators of the cooling devices are detected when the refrigerant supply devices are operated/stopped in accordance with the change patterns which are stored in advance, which are determined on the basis of the number of refrigerant supply devices, and in which states of the refrigerant supply devices are changed with time by being switched between the in-operation state and the stopped state. It is determined that, among the cooling devices, a cooling device having the evaporator whose temperature changes in synchronization with the in-operation/stopped state of a refrigerant supply device among the refrigerant supply devices is connected to the refrigerant supply device using the corresponding refrigerant pipe. In the change patterns, appropriate combinations of the in-operation state and the stopped state of the refrigerant supply devices are included.

Accordingly, with the refrigeration managing apparatus according to the present invention, control of operating/stopping the multiple refrigerant supply devices is performed in accordance with the change patterns that are automatically determined in advance. Thus, changes in the temperatures, which are caused by operating/stopping the refrigerant supply devices, of the evaporators of the individual cooling devices are measured, whereby the connection relationships of the refrigerant pipes connected between the individual refrigerant supply devices and the individual cooling devices can be determined in a time period shorter than that in the related art.

Furthermore, it is preferable that the refrigeration managing apparatus according to the present disclosure further include a signal processing section. The signal processing section assigns addresses to the cooling devices in an order in which changes in the temperatures of the evaporators of the cooling devices are detected when the refrigerant supply devices are operated/stopped in accordance with the change patterns stored in the storage section.

With the refrigeration managing apparatus according to the present invention, addresses are assigned to the cooling devices in an order in which changes in the temperatures of the evaporators of the cooling devices are detected when the refrigerant supply devices are operated/stopped in accordance with the change patterns that are automatically determined in advance. Thus, the connection relationships of the refrigerant pipes connected between the individual refrigerant supply devices and the individual cooling devices can be determined automatically. Therefore, the workload of an operator can be reduced.

Moreover, in the refrigeration managing apparatus according to the present invention, it is preferable that the signal processing section assign addresses to the cooling devices in an order in which the temperatures of the evaporators of the cooling devices decrease by a predetermined amount or more.

Even when all of the refrigerant supply devices are devices of the same type, the operation characteristics thereof change in accordance with the types of products displayed therein, the installation location thereof, the ambient temperatures thereof, or the like. Accordingly, in the refrigeration managing apparatus according to the present invention, addresses are assigned to the cooling devices in an order in which the temperatures of the evaporators of the cooling devices decrease by a predetermined amount or more. Thus, even when the multiple cooling devices are connected in parallel to the same refrigerant supply device, the individual cooling devices can be distinguished from one another, and addresses can be assigned to the cooling devices.

Note that, it is supposed that a criterion for a change in the temperature of the evaporator of each of the cooling devices for a case of assigning an address is set to be less than a predetermined amount of temperature decrease (for example, 5° C.). In this case, changes in the temperatures of the evaporators at an early stage at which cooled refrigerants start flowing differ in accordance with the individual cooling devices. Thus, changes in the temperatures in the multiple cooling devices may occur sharply and simultaneously, and the individual cooling devices may not be accurately distinguished from one another. Furthermore, when the refrigerant supply devices are reactivated after the refrigerant supply devices are stopped, the evaporators may be cooled already, and the temperatures of the evaporators may satisfy the criterion. Accordingly, the cooling devices may not be distinguished from one another. The upper limit value of the criterion for a change in the temperature in each of the cooling devices may be 10° C. or less because the time taken to distinguish the individual cooling devices from one another becomes longer when the upper limit value is large.

Additionally, in the refrigeration managing apparatus according to the present invention, it is preferable that the change patterns be patterns including the minimum number of attempts to operate/stop the refrigerant supply devices. The minimum number of attempts is determined in accordance with the number of refrigerant supply devices. It is preferable that the controller include a device control unit, a measurement unit, and an analysis unit. The device control unit controls the refrigerant supply devices in parallel with reference to change patterns, the number of change patterns corresponding to the number of refrigerant supply devices, among the change patterns stored in the storage section. The measurement unit measures the temperatures of the evaporators included in the cooling devices. The analysis unit determines the refrigerant piping groups on the basis of the temperatures, which have been measured by the measurement unit, of the evaporators included in the cooling devices.

With the refrigeration managing apparatus according to the present invention, the individual refrigerant supply devices are controlled in parallel in accordance with the change patterns that include the minimum number, which is determined in accordance with the number of refrigerant supply devices, of attempts to operate/stop the refrigerant supply devices and that are patterns of the in-operation state and the stopped-state of the refrigerant supply devices. Accordingly, the number of times the refrigerant supply devices are operated/stopped can be reduced, and the time taken to determine the refrigerant piping groups can be reduced.

Furthermore, it is preferable that the refrigeration managing apparatus according to the present disclosure further include a generation section that generates the change patterns.

With the refrigeration managing apparatus according to the present invention, new change patterns are generated for every time control is performed on the refrigerant supply devices. Accordingly, change patterns can be generated always in accordance with a configuration of a cooling system.

Moreover, in the refrigeration managing apparatus according to the present invention, it is preferable that the generation section divide the refrigerant supply devices into two groups, repeatedly perform a grouping process of further dividing each of the two groups into two groups until grouping is no longer able to be performed, and generate change patterns in which the in-operation state of the refrigerant supply devices is assigned to one of the two groups which are generated every time the grouping process is performed, and in which the stopped state of the refrigerant supply devices is assigned to the other group.

With the refrigeration managing apparatus according to the present invention, change patterns are generated by the generation section as described above. Accordingly, a change pattern among the change patterns can be set for each of the multiple refrigerant supply devices so that the change pattern is different from any one of the change patterns set for the other refrigerant supply devices. Thus, for all of the refrigerant supply devices and the cooling devices, connection relationships of the refrigerant pipes connected between the individual refrigerant supply devices and the individual cooling devices can be determined in a short time period.

Additionally, in the refrigeration managing apparatus according to the present invention, it is preferable that the generation section generate change patterns in which each of the refrigerant supply devices is operated at least once.

With the refrigeration managing apparatus according to the present invention, each of the refrigerant supply devices for which a corresponding one of the change patterns is set is operated at least once. Accordingly, incorrect placement of the refrigerant pipes that is caused by an implementation mistake or the like can be detected.

Furthermore, in the refrigeration managing apparatus according to the present invention, it is preferable that, in a case in which the refrigerant supply devices are divided into groups corresponding to set temperature ranges or device type information items, the device control unit control the refrigerant supply devices belonging to the groups in parallel with reference to change patterns, the number of change patterns corresponding to the number of refrigerant supply devices included in the groups, among the change patterns stored in the storage section.

With the refrigeration managing apparatus according to the present invention, in a case in which multiple temperature set ranges such as a temperature set range of freezing devices and a temperature set range of chilling devices exists, cooling set temperatures, which are set temperatures for a case of cooling, of the cooling devices are different from one another. Accordingly, even when one refrigerant supply device belonging to one group and one refrigerant supply device belonging to another group are controlled in parallel in accordance with the same change pattern, the refrigerant piping groups can be determined. The number of attempts can be reduced, compared with the number of attempts in a case in which each of the refrigerant supply devices is controlled in accordance with a change pattern different from any one of change patterns that are set for the other refrigerant supply devices.

BRIEF DESCRIPTION OF THE DRAWINGS

Advantages of the invention will become apparent in the following description taken in conjunction with the drawings, wherein:

FIGS. 9A to 9C are diagrams illustrating examples of a change-pattern table in the second embodiment;

FIGS. 11A and 11B are diagrams illustrating other examples of the change-pattern table in the second embodiment.

DETAILED DESCRIPTION OF THE DRAWINGS

Hereinafter, embodiments of the present disclosure will be described in detail with reference to the drawings. However, the embodiments given below are provided for the purpose of describing examples of refrigeration managing apparatuses in order to realize the technical concept of the present invention. It is not intended that the present disclosure is limited to the refrigeration managing apparatuses described in the embodiments. The present disclosure may also be equally applied to other embodiments included in the scope of the claims.

First Embodiment

Examples of cooling devices used for stores include showcases for chilling and freezing, refrigerators and freezers that are installed in kitchens or backyards, and air conditioners used for stores. For example, in an example of a showcase, an outdoor unit having a compressor and a condenser is placed outside or on the rooftop, and an indoor unit having an evaporator and a decompressor is placed inside a store. Typically, multiple indoor units and a single outdoor unit are installed so that the indoor units are connected, using refrigerant pipes, to the outdoor unit in parallel to form refrigeration cycles. Furthermore, in the store, although not illustrated, a large number of devices that consume electric power, such as illumination devices and heating cooking devices, are also installed.

Figure 1:
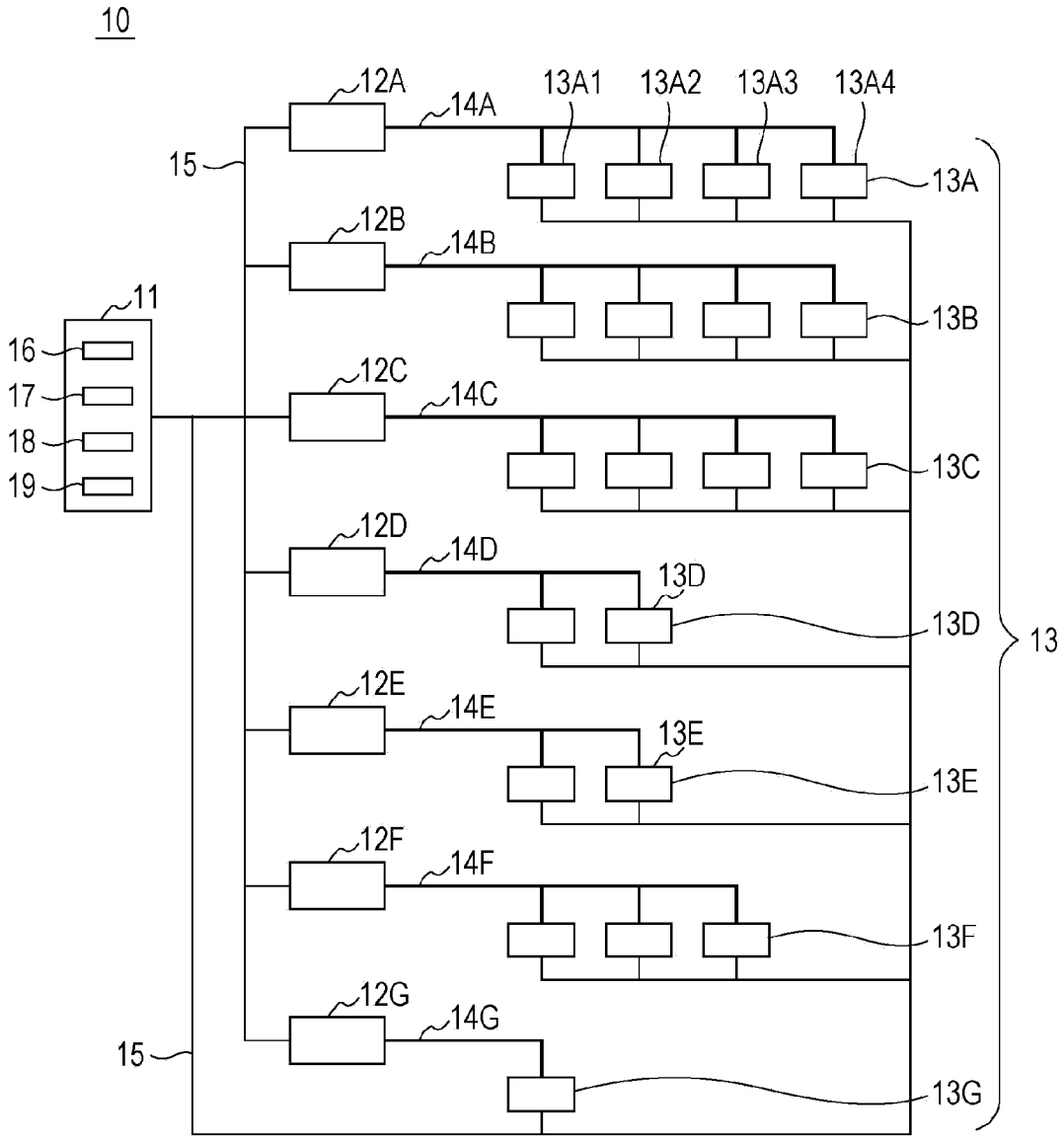
FIG. 1 is a schematic diagram of a cooling system used for a store in a first embodiment.

Note that, in a first embodiment, as illustrated in FIG. 1, an example in which a cooling system 10 used for a store is installed in a supermarket is provided. A case is described, in which seven refrigerant supply devices 12A to 12G (hereinafter, may simply be referred to as "refrigerant supply devices 12" when it is not necessary to distinguish the refrigerant supply devices 12A to 12G from one another) that serve as outdoor units are installed, and in which one cooling device 13 or two, three, or four cooling devices 13 that serve as indoor units connected to each of the refrigerant supply devices 12 are installed. Note that, here, showcases 13A to 13C and 13G and air conditioners 13D to 13F that serve as the cooling devices 13 are provided and described as examples.

Furthermore, the individual refrigerant supply devices 12 are connected, using communication lines 15, to a refrigeration managing apparatus 11 for refrigerant supply devices. The refrigeration managing apparatus 11 performs, for example, for each of the showcases 13A to 13C and 13G and the air conditioners 13D to 13F, the following: management of a time at which a shift signal for a temperature set value is output for the nighttime; management of, for air conditioning, an operation start time, a temperature set value, and outputting of a signal for switching between heating and cooling; and management of a lightning time for illumination. In addition, the refrigeration managing apparatus 11 includes a storage section 16, a change-pattern generating section 17, a signal processing section 18, and a controller 19. In the storage section 16, change pattern in which the states of the refrigerant supply devices 12 are changed with time by being switched between an in-operation state and a stopped state are stored. The change-pattern generating section 17 generates new change patterns for every time control is performed on the refrigerant supply devices. The signal processing section 18 assigns addresses to the cooling devices 13 in an order in which changes in the temperature of the evaporators of the cooling devices 13 are detected when the refrigerant supply devices are operated/stopped. The controller 19 controls the in-operation state and the stopped state of the refrigerant supply devices 12.

The individual refrigerant supply devices 12A to 12G are connected to the corresponding cooling devices 13 using refrigerant pipes 14A to 14G (hereinafter, may simply be referred to as "refrigerant pipes 14" when it is not necessary to distinguish the refrigerant pipes 14A to 14G from one another), respectively. Note that, in the first embodiment, the showcases 13A to 13C and 13G are connected to the four refrigerant supply devices 12A to 12C and 12G, respectively, and the air conditioners 13D to 13F are connected to the three refrigerant supply devices 12D to 12F, respectively. In this manner, each of the refrigerant supply devices 12, the showcases 13A to 13C and 13G, and the air conditioners 13D to 13F is managed by the refrigeration managing apparatus 11 via a corresponding one of the communication lines 15.

Figure 2:
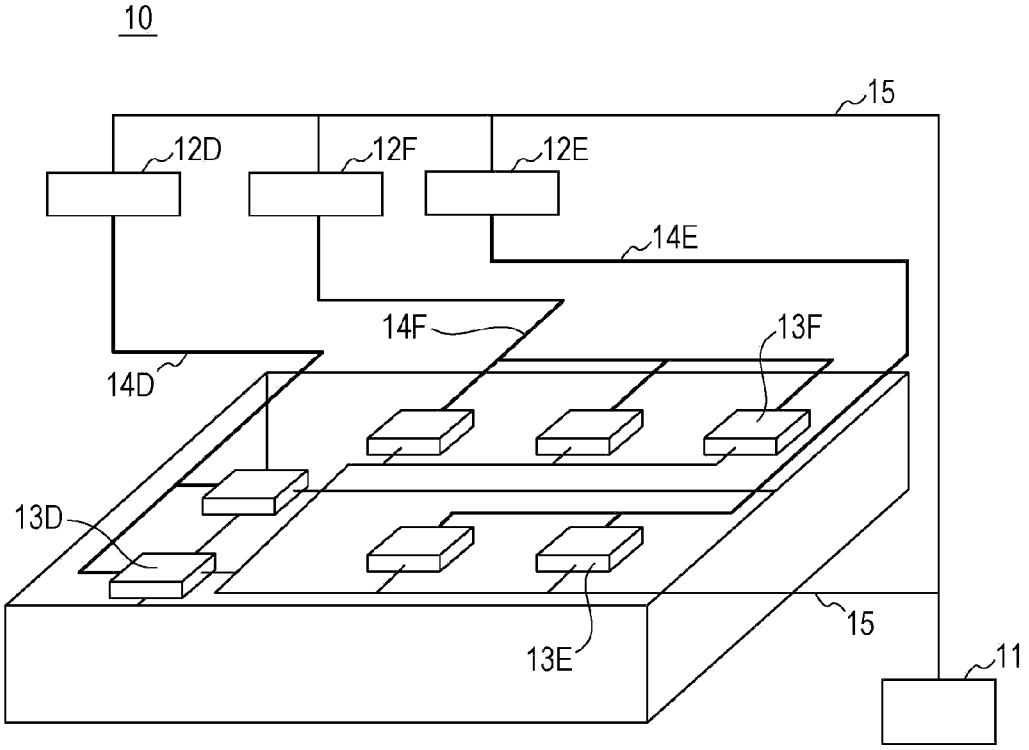
FIG. 2 is a schematic diagram of an air conditioner serving as a cooling device.

Regarding a configuration of the air conditioners 13D to 13F serving as the cooling devices 13, as illustrated in FIG. 2, the three refrigerant supply devices 12D to 12F are installed as outdoor units, and the two or three air conditioners 13D to 13F serving as the cooling devices 13 are connected to the refrigerant supply devices 12D to 12F using the refrigerant pipes 14D to 14F, respectively. Each of the refrigerant supply devices 12D to 12F and the air conditioners 13D to 13F is connected to the refrigeration managing apparatus 11 via a corresponding one of the communication lines 15. Operation of each of the refrigerant supply devices 12D to 12F and the air conditioners 13D to 13F is managed.

Figure 3:
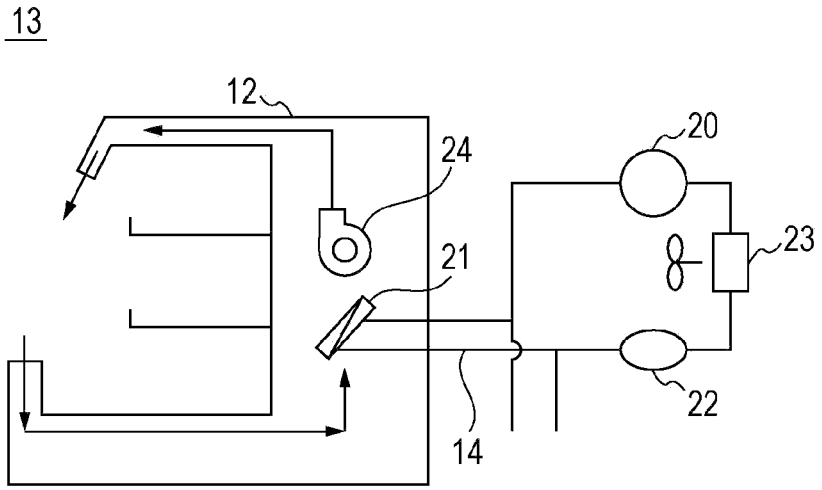
FIG. 3 is a schematic diagram of a showcase serving as a cooling device.

As illustrated in FIG. 3, each of the showcases 13A to 13C and 13G serving as the cooling devices 13 has an evaporator 21 therein. The air cooled by the evaporator 21 is circulated through each of the showcases 13A to 13C and 13G by utilizing a fan 24 so that products displayed in the showcase such as perishables or frozen food can be at an appropriate temperature. The evaporator 21 is provided in each of the showcases 13A to 13C and 13G. The evaporator 21, a compressor 20 and a condenser 23, which are included in each of the refrigerant supply devices 12A to 12C and 12G, and a decompressor 22 are connected in a loop using a corresponding one of the refrigerant pipes 14A to 14C and 14G, thereby forming a refrigeration cycle.

Note that a cooling set temperature, which is a set temperature for a case of cooling, differs in accordance with products displayed in each of the showcases 13A to 13C and 13G. For example, the cooling set temperature ranges from approximately −2° C. to 2° C. for fresh fish and meat, ranges from approximately 5° C. to 10° C. for fruit and vegetables, ranges from approximately 3° C. to 7° C. for daily foods, dairy products, and side dishes, and ranges from approximately −18° C. to −22° C. for frozen food and ice cream. Additionally, the differences among power consumptions of the showcases 13A to 13C and 13G are generated due to the differences among the cooling set temperatures thereof.

Figure 4:
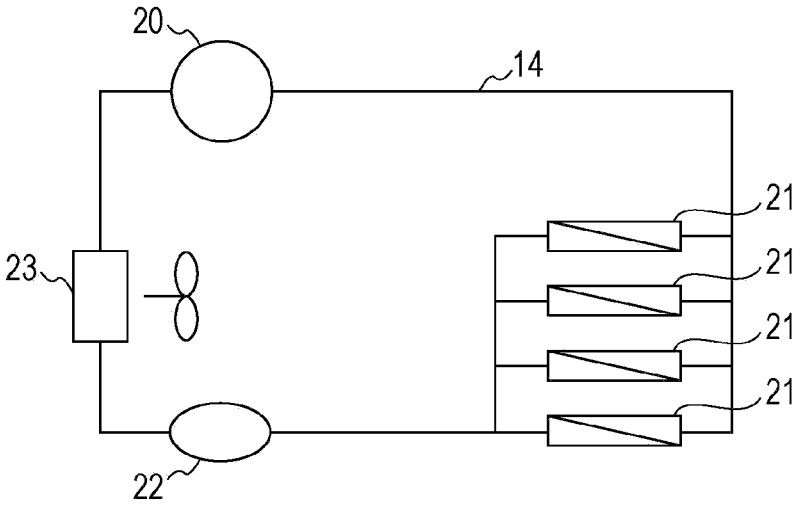
FIG. 4 is a schematic diagram illustrating a refrigeration cycle.

Here, the refrigeration cycle will be described. As illustrated in FIG. 4, the refrigeration cycle is formed so as to include the compressor 20 and the condenser 23, which are included in each of the refrigerant supply devices 12, and the decompressor 22 and the evaporator 21, which are included in each of the showcases 13A to 13C and 13G and the air conditioners 13D to 13F serving as the cooling devices 13. Note that, in the refrigeration cycle illustrated in FIG. 4, four evaporators 21, i.e., four cooling devices 13, are connected to one compressor 20. Accordingly, in the refrigeration cycle illustrated in FIG. 4, the compressor 20, the condenser 23, and the decompressor 22 are provided as common components, and refrigeration cycles corresponding to the showcases 13A to 13C and 13G serving as the cooling devices 13, i.e., four refrigeration cycles, exist. A refrigerant piping group is formed for each of the refrigeration cycles.

In the refrigeration cycle, when the compressor 20 of the refrigerant supply device 12 is operated, a high-temperature and high-pressure refrigerant compressed by the compressor 20 is discharged from the compressor 20, and is input to the condenser 23 so as to be cooled. The cooled refrigerant enters a low-temperature high-pressure state, and flows into each of the evaporators 21 via the decompressor 22. In the decompressor 22, the refrigerant is decompressed, and evaporates in the evaporator 21, thereby absorbing heat of vaporization from the surroundings, so that the inside of the corresponding cooling device 13 is cooled. A configuration is provided, in which the low-temperature low-pressure refrigerant vaporized in the evaporator 21 is circulated through the compressor 20 of the refrigerant supply device 12.

Next, a process of determining the refrigerant pipes 14 that are formed between the individual refrigerant supply devices 12 and the individual cooling devices 13 will be specifically described. The refrigeration managing apparatus 11 includes the storage section 16, the change-pattern generating section 17, the signal processing section 18, and the controller 19. First, in a case of determining the refrigerant pipes 14 formed between the individual refrigerant supply devices 12 and the individual cooling devices 13, change patterns in which the states of the refrigerant supply devices 12 are changed with time by being switched between an in-operation state (on-state) and a stopped state (off-state) are stored.

Note that the change patterns may be certain predetermined change patterns, or may be new change patterns that are generated for every time control is performed on the refrigerant supply devices. However, it is preferable that the change patterns be change patterns in which each of the refrigerant supply devices is operated at least once (determination may be performed under an assumption without operating the last one among the refrigerant supply devices). Additionally, in a case in which the individual refrigerant supply devices 12 can be divided into multiple groups corresponding to multiple temperature set ranges or device type information items, the change patterns may be change patterns that are obtained for the groups by generating, for each of the groups, change patterns, the number of change patterns corresponding to the number of refrigerant supply devices 12 included in the group.

Examples of the change patterns that are generated by the change-pattern generating section 17 will be described with reference to FIGS. 5A and 5B. However, in FIGS. 5A and 5B, a case in which the refrigerant supply devices 12A to 12C and 12G are used is illustrated, and a case in which the refrigerant supply devices 12D to 12F are used is not illustrated.

Figure 5A:
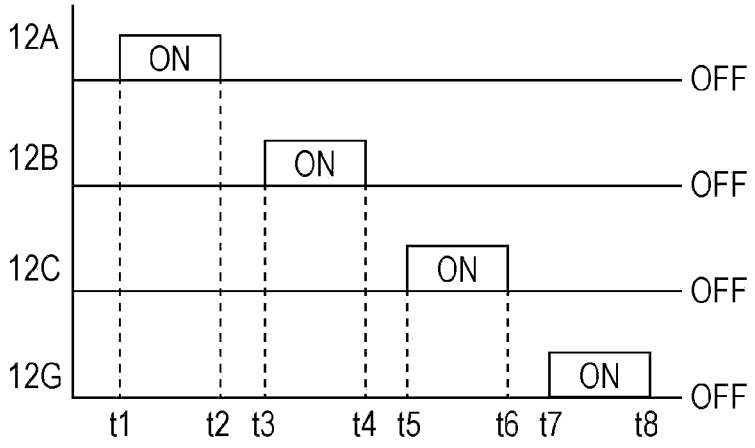
FIG. 5A is a timing chart illustrating specific examples of change patterns.
Figure 5B:
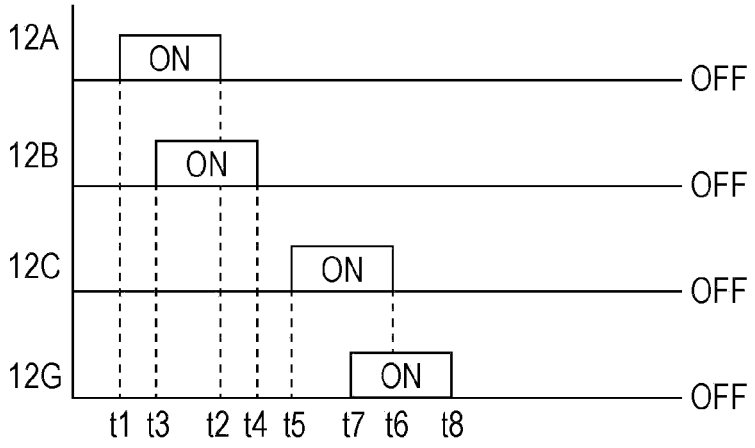
FIG. 5B is a timing chart illustrating modification examples of the change patterns.

FIG. 5A is a timing chart indicating that the states of the refrigerant supply devices 12A to 12C and 12G are changed with time by being switched between the in-operation state (the on-state) and the stopped state (the off-state). Here, change patterns are generated, in which the states of the refrigerant supply devices 12A to 12C and 12G are changed as follows: the refrigerant supply device 12A is made to enter the on-state at a time t1, and is made to enter the off-state at a time t2; the refrigerant supply device 12B is made to enter the on-state at a time t3, and is made to enter the off-state at a time t4; the refrigerant supply device 12C is made to enter the on-state at a time t5, and is made to enter the off-state at a time t6; and the refrigerant supply device 12G is made to enter the on-state at a time t7, and is made to enter the off-state at a time t8. Note that, control of making the refrigerant supply devices 12A to 12C and 12G enter the on-state/off-state is performed by the controller 19.

The change patterns may include a case in which the refrigerant supply devices 12A to 12C and 12G are made to enter the on-state on a one-by-one basis as illustrated in FIG. 5A. Additionally, the change patterns may include a case in which multiple refrigerant supply devices 12 among the refrigerant supply devices 12A to 12C and 12G are made to simultaneously enter the on-state. An operator may arbitrarily set each of the refrigerant supply devices 12A to 12C and 12G to be in the on-state. The temperatures of the evaporators 21 of all of the cooling devices 13 are monitored by the signal processing section 18 via the communication lines 15.

For example, when the refrigerant supply device 12A is set to be in the on-state between the times t1 and t2, among the cooling devices 13, cooling devices 13 having the evaporators 21 whose temperatures decrease are determined from temperature signals obtained via the communication lines 15. In this manner, the multiple showcases 13A that are connected to the refrigerant supply device 12A using a refrigerant piping group including the refrigerant pipe 14A directly connected to the refrigerant supply device 12A can be determined.

Similarly, as illustrated in FIG. 5A, the multiple showcases 13B, 13C, and 13G that are connected to the refrigerant supply devices 12B, 12C, and 12G using refrigerant piping groups including the refrigerant pipes 14B, 14C, and 14G directly connected to the refrigerant supply devices 12B, 12C, and 12G can be determined by sequentially switching the states of the refrigerant supply devices 12B, 12C, and 12G to the on-state on an individual basis, respectively.

Furthermore, the multiple air conditioner 13D to 13F that are connected to the refrigerant supply devices 12D to 12F using refrigerant piping groups including the refrigerant pipes 14D to 14F directly connected to the refrigerant supply devices 12D to 12F can be determined by performing such an operation on the refrigerant supply devices 12D to 12F.

Note that, when the change patterns in which the states of the refrigerant supply devices 12A to 12C and 12G are made to enter the on-state on a one-by-one basis as illustrated in FIG. 5A are employed, it takes long time to determine, for all of the refrigerant supply devices 12A to 12C and 12G, the cooling devices 13 that are connected to the refrigerant supply devices 12A to 12C and 12G using refrigerant piping groups including the refrigerant pipes 14A to 14C and 14G directly connected to the refrigerant supply devices 12A to 12C and 12G, respectively. For this reason, as illustrated in FIG. 5B, multiple refrigerant supply devices 12 that are arbitrarily selected from the refrigerant supply devices 12A to 12C and 12G, e.g., the refrigerant supply devices 12A and 12B, may be made to enter the on-state at times shifted from each other and to be in the on-state in the same time period.

When such change patterns are employed, for example, times at which decreases in the temperatures of the evaporators start due to the refrigerant flowing from the refrigerant supply device 12A and times at which decreases in the temperatures of the evaporators start due to the refrigerant flowing from the refrigerant supply device 12B are shifted from each other. Accordingly, the multiple showcases 13A, which are connected to the refrigerant piping group including the refrigerant pipe 14A directly connected to the refrigerant supply device 12A, and the multiple showcases 13B, which are connected to the refrigerant piping group including the refrigerant pipe 14B directly connected to the refrigerant supply device 12B, can be distinguished from each other and determined.

Furthermore, when the refrigerant supply devices 12 can be divided into multiple groups corresponding to multiple temperature set ranges or device type information items, the cooling set temperature of the cooling devices 13 differs for each of the groups. Accordingly, even when one refrigerant supply device 12 belonging to one group and one refrigerant supply device 12 belonging to another group are controlled in parallel in accordance with the same change pattern, the multiple cooling devices 13 belonging to the individual groups can be distinguished from each other and determined.

Figure 5C:
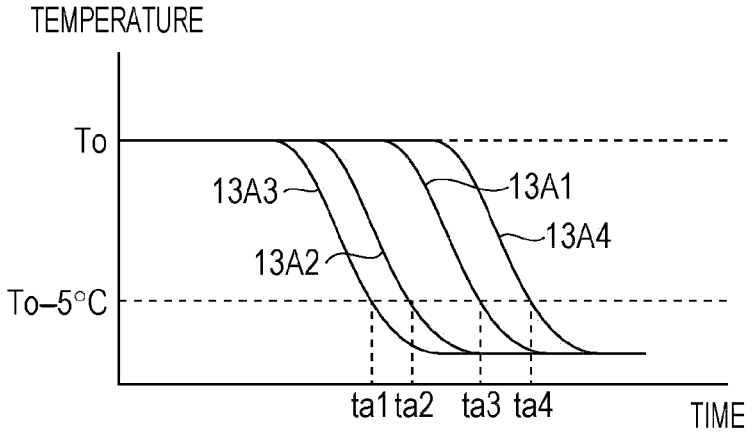
FIG. 5C is a graph of changes in the temperatures of evaporators of multiple cooling devices connected to the same refrigerant pipe.

Additionally, for example, regarding individual showcases 13A1 to 13A4 included in the multiple showcases 13A, even when all of the showcases 13A1 to 13A4 are devices of the same type, the set temperatures of the showcases 13A1 to 13A4 differ in accordance with the types of products displayed therein. In addition, the operation characteristics of the showcases 13A1 to 13A4 differ in accordance with the installation locations thereof, the ambient temperatures thereof, or the like. Accordingly, for example, as illustrated in FIG. 5A, when the only refrigerant supply device 12A is made to enter the on-state, as illustrated in FIG. 5C, times ta1 to ta4 at which the temperatures of the individual evaporators 21 of the multiple showcases 13A1 to 13A4 decrease from a first temperature To by a predetermined amount or more, e.g., 5° C. or more, are different from each other.

Thus, the multiple showcases 13A1 to 13A4 can be sequentially determined in an order from a showcase having the evaporator 21 whose temperature first decreases by the predetermined amount or more, e.g., 5° C. or more (hereinafter, referred to as "assignment of addresses"). In other words, in the example illustrated in FIG. 5C, an address a1 is assigned to the showcase 13A3, an address a2 is assigned to the showcase 13A2, an address a3 is assigned to the showcase 13A1, and an address a4 is assigned to the showcase 13A4. Accordingly, even when the multiple showcases 13A1 to 13A4 are connected to the same refrigerant supply device 12A in parallel, the addresses a1 to a4 can be assigned to the individual showcases 13A1 to 13A4 in a one-to-one manner. Thus, the connection relationships of the refrigerant pipes connected between the refrigerant supply device 12A and the individual showcases 13A1 to 13A4 can be automatically determined. Therefore, the operator can easily determine the connection relationships of the refrigerant pipes connected between the individual refrigerant supply device 12 and the individual cooling devices 13.

Note that a criterion for a change in the temperature of the evaporator 21 of each of the cooling devices 13 for a case of assigning an address, i.e., a criterion by which an address is assigned and which is a criterion for a predetermined amount of temperature decrease in the temperature of the evaporator 21, is set to an amount of temperature decrease that is less than 5° C. In this case, the temperatures of the evaporators 21 at an early stage at which the cooled refrigerant starts flowing from the refrigerant supply device 12 have not entered a state in which the temperatures steadily change. Accordingly, the fluctuation range of the temperatures of the evaporators 21 is large. Thus, the individual cooling devices 13 may not be accurately distinguished from one another. Thus, it is preferable that the criterion for a change in the temperature of the evaporator 21 of each of the cooling devices 13 for a case of assigning an address be an amount of temperature decrease that is 5° C. or more. Note that the upper limit value of the criterion for a change in the temperature in each of the cooling devices may be 10° C. or less because the time taken to distinguish the individual cooling devices from one another becomes longer when the upper limit value is large.

Note that, an example in which addresses are assigned to the multiple showcases 13A1 to 13A4 when the only refrigerant supply device 12A is made to enter the on-state is described here. However, the above-described manner in which addresses are assigned may be similarly applied to even the following cases: as illustrated in FIG. 5A, the change patterns in which the refrigerant supply devices 12A to 12C and 12G are made to enter the on-state on a one-by-one basis are employed; and, as illustrated in FIG. 5B, multiple refrigerant supply devices 12, e.g., the refrigerant supply devices 12A and 12B, are arbitrarily selected from the refrigerant supply devices 12A to 12C and 12G, and the refrigerant supply devices 12A and 12B are made to enter the on-state at times shifted from each other and to be in the on-state in the same time period.

Second Embodiment

Next, a second embodiment of the present disclosure will be described with reference to FIGS. 6 to 11B. More specifically, the second embodiment will be described in the order of section headings as follows: 1. Overall configuration of cooling system used for store; 2. Configuration of refrigeration managing apparatus; 3. Operation of refrigeration managing apparatus; and 4. Advantages. In the drawings used to describe the second embodiment given below, elements that are the same as or similar to each other are denoted by the same or similar reference numerals.

1. Overall Configuration of Cooling System Used for Store

Figure 6:
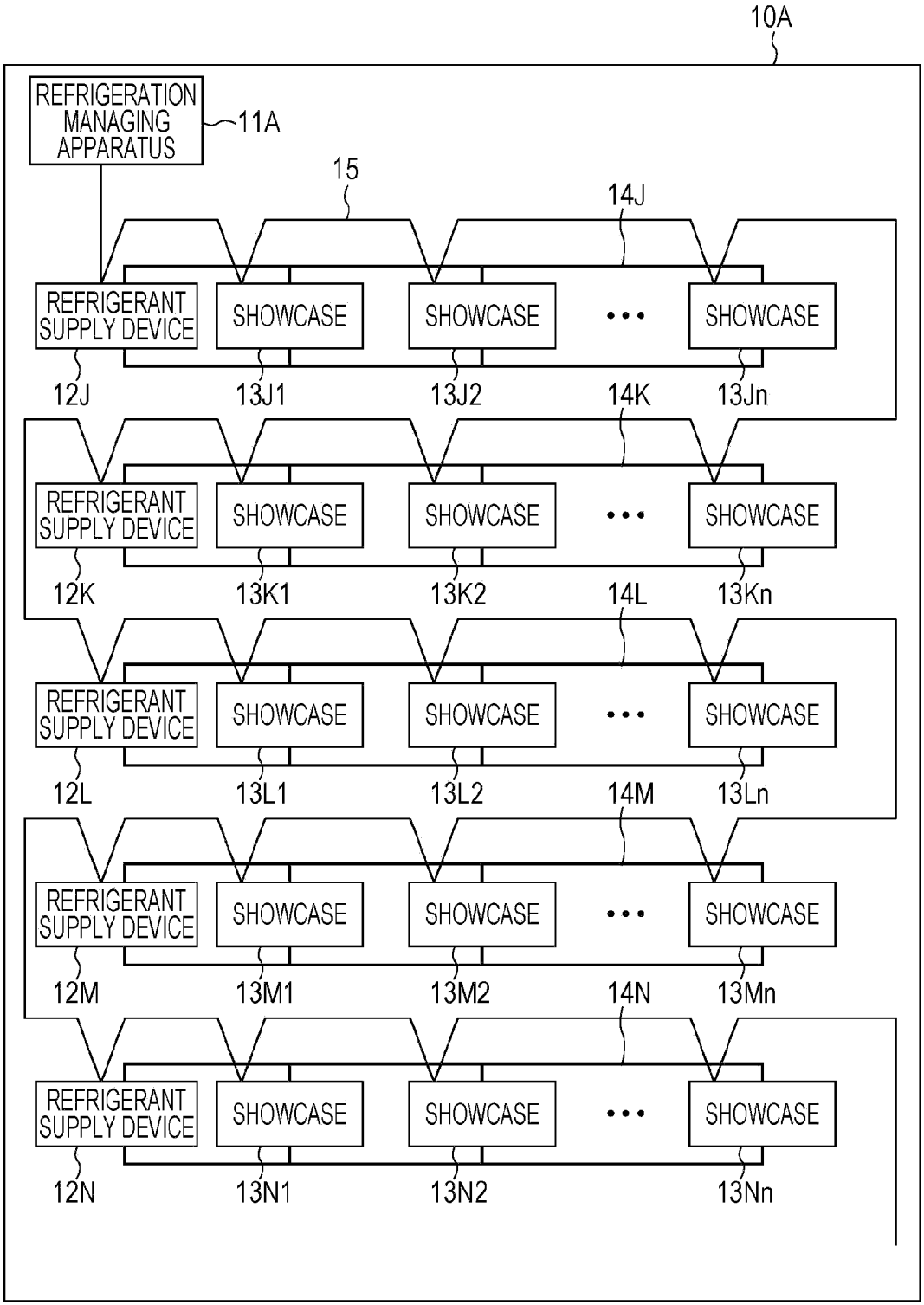
FIG. 6 is a diagram schematically illustrating an overall configuration of a cooling system used for a store in a second embodiment.

FIG. 6 is a diagram schematically illustrating an overall configuration of a cooling system 10A used for a store in the second embodiment. In the second embodiment, a case in which the cooling system 10A used for a store is installed in a supermarket or the like will be described.

As illustrated in FIG. 6, the cooling system 10A used for a store in the second embodiment includes a refrigeration managing apparatus 11A serving as an integration controller, refrigerant supply devices 12J to 12N, showcases 13J1 to 13Jn, showcases 13K1 to 13Kn, showcases 13L1 to 13Ln, showcases 13M1 to 13Mn, and showcases 13N1 to 13Nn (hereinafter, may be collectively referred to as "showcases 13J1 to 13Nn") that serve as the cooling devices 13, refrigerant pipes 14J to 14N, and a communication line 15.

The refrigerant supply devices 12J to 12N supply refrigerants to the showcases 13J1 to 13Nn serving as the cooling devices 13. Products that are displayed in the showcases 13J1 to 13Nn as subjects to be cooled are cooled by the supplied refrigerants. The showcases 13J1 to 13Nn are installed in places physically distant from one another in accordance with the layout of a salesroom, the room arrangement of a store, or the like.

Referring to FIG. 6, the refrigerant pipe 14J connects the refrigerant supply device 12J and the showcases 13J1 to 13Jn. The refrigerant is circulated between the refrigerant supply device 12J and the showcases 13J1 to 13Jn via the refrigerant pipe 14J. One refrigerant piping group is constituted by the refrigerant supply device 12J and the showcases 13J1 to 13Jn.

The refrigerant pipe 14K connects the refrigerant supply device 12K and the showcases 13K1 to 13Kn. The refrigerant is circulated between the refrigerant supply device 12K and the showcases 13K1 to 13Kn via the refrigerant pipe 14K. Another refrigerant piping group is constituted by the refrigerant supply device 12K and the showcases 13K1 to 13Kn.

The refrigerant pipe 14L connects the refrigerant supply device 12L and the showcases 13L1 to 13Ln. The refrigerant is circulated between the refrigerant supply device 12L and the showcases 13L1 to 13Ln via the refrigerant pipe 14L. Another refrigerant piping group is constituted by the refrigerant supply device 12L and the showcases 13L1 to 13Ln.

The refrigerant pipe 14M connects the refrigerant supply device 12M and the showcases 13M1 to 13Mn. The refrigerant is circulated between the refrigerant supply device 12M and the showcases 13M1 to 13Mn via the refrigerant pipe 14M. Another refrigerant piping group is constituted by the refrigerant supply device 12M and the showcases 13M1 to 13Mn.

The refrigerant pipe 14N connects the refrigerant supply device 12N and the showcases 13N1 to 13Nn. The refrigerant is circulated between the refrigerant supply device 12N and the showcases 13N1 to 13Nn via the refrigerant pipe 14N. Another refrigerant piping group is constituted by the refrigerant supply device 12N and the showcases 13N1 to 13Nn.

The communication line 15 is routed so as to connect the refrigeration managing apparatus 11A, the individual refrigerant supply devices 12J to 12N, and the individual showcases 13J1 to 13Nn. The multiple refrigerant supply devices 12J to 12N and the multiple showcases 13J1 to 13Nn included in the cooling system 10A used for a store are connected by the communication line 15 as a network. The refrigeration managing apparatus 11A controls the individual refrigerant supply devices 12J to 12N and the individual showcases 13J1 to 13Nn.

2. Configuration of Refrigeration Managing Apparatus

Figure 7:
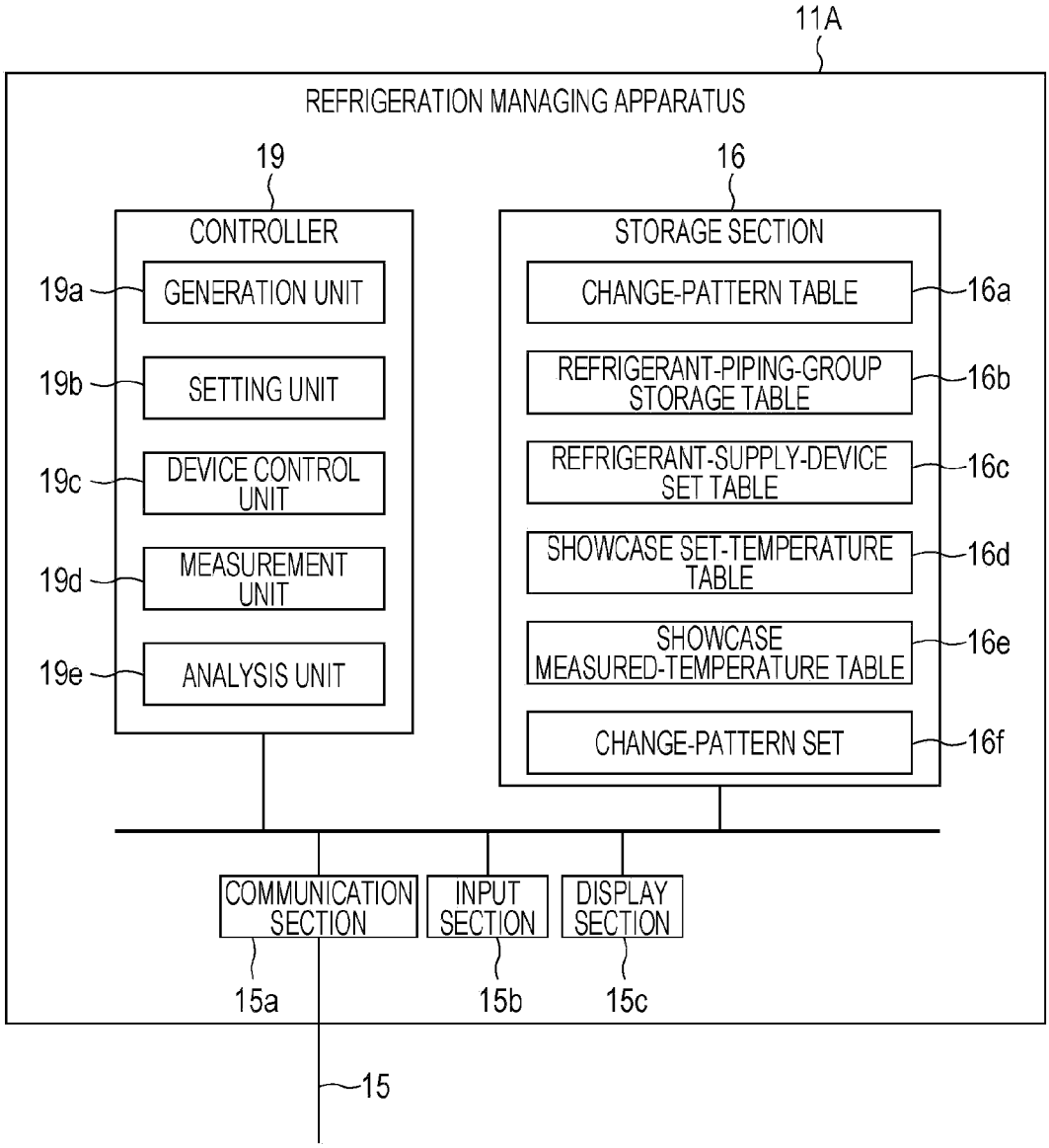
FIG. 7 is a diagram of a configuration of a refrigeration managing apparatus according to the second embodiment.

Next, a configuration of the refrigeration managing apparatus 11A will be described. FIG. 7 is a diagram of the configuration of the refrigeration managing apparatus 11A. The refrigeration managing apparatus 11A performs a process of determining, among the refrigerant supply devices 12J to 12N, a refrigerant supply device to which each of the multiple showcases 13J1 to 13Nn is connected via a corresponding one of the refrigerant pipes 14J to 14N, i.e., a process (refrigerant-piping-group determination process) of determining one refrigerant supply device and multiple showcases that constitute each of the refrigerant piping groups.

As illustrated in FIG. 7, the refrigeration managing apparatus 11A includes a controller 19, a storage section 16, a communication section 15*a*, an input section 15*b*, and a display section 15*c*. The controller 19 is constituted by, for example, a central processing unit (CPU), and controls various types of functions of the cooling system 10A used for a store. The controller 19 includes a generation unit 19*a*, a setting unit 19*b*, a device control unit 19*c*, a measurement unit 19*d*, and an analysis unit 19*e*.

Furthermore, the storage section 16 stores a change-pattern table 16*a*, a refrigerant-piping-group storage table 16*b*, a refrigerant-supply-device set table 16*c*, a showcase set-temperature table 16*d*, and a showcase measured-temperature table 16*e*.

Figure 8:
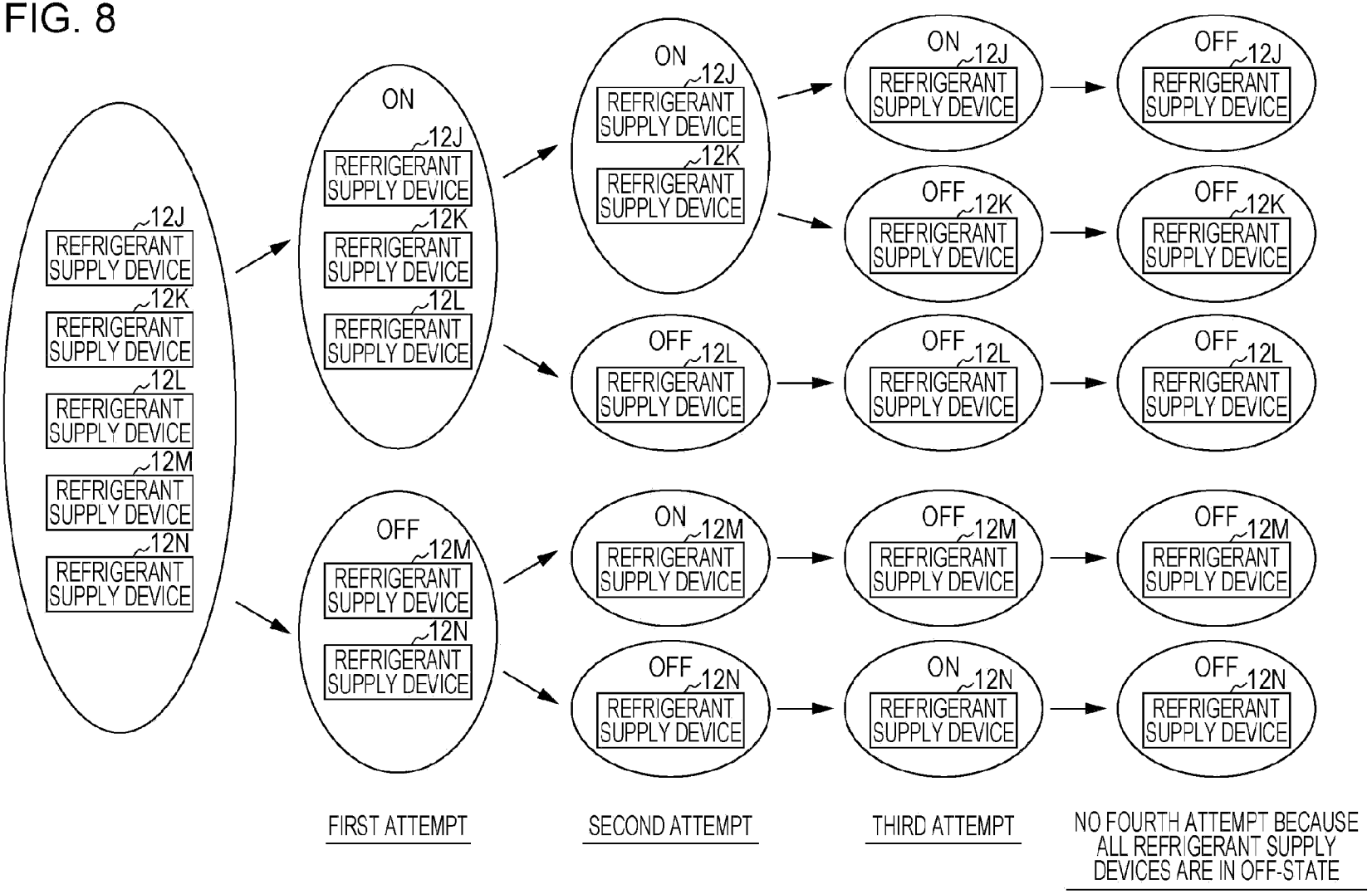
FIG. 8 is a diagram illustrating an example of a procedure of generating change patterns in the second embodiment.

The generation unit 19*a* generates change patterns that are patterns of the in-operation state and the stopped state of the refrigerant supply devices. More specifically, the generation unit 19*a* generates change patterns as described below. FIG. 8 is a diagram illustrating an example of a procedure of generating change patterns. The generation unit 19*a* divides the refrigerant supply devices 12J to 12N, which are subjects to be processed in the refrigerant-piping-group determination process, into two groups. Referring to FIG. 8, the refrigerant supply devices 12J to 12N are divided into a group constituted by the refrigerant supply devices 12J to 12L and a group constituted by the refrigerant supply devices 12M and 12N. Next, the generation unit 19*a* assigns the in-operation state (the on-state) to the refrigerant supply devices belonging to one of the two groups, and assigns the stopped state (the off-state) to the refrigerant supply devices belonging to the other group. Note that the on-state and the off-state are not limited to the in-operation state and the stopped state, and may be an increase and a decrease in the output of each of the refrigerant supply devices.

Next, the generation unit 19*a* further divides each of the two formed groups into two groups. The generation unit 19*a* assigns the on-state to the refrigerant supply devices belonging to one of the two groups, and assigns the off-state to the refrigerant supply devices belonging to the other group. The generation unit 19*a* repeats such a grouping process until grouping can no longer be performed, i.e., until the number of refrigerant supply devices belonging to each of the groups becomes one.

As a result of repeating the grouping process, when the number of refrigerant supply devices belonging to each of the groups has become one, in a case in which the state immediately previously assigned to the one refrigerant supply device is the on-state, next, the generation unit 19*a* assigns the off-state to the refrigerant supply device. In contrast, in a case in which the state immediately previously assigned to the refrigerant supply device is the off-state and in which the on-state has never been assigned to the refrigerant supply device, next, the generation unit 19*a* assigns the on-state to the refrigerant supply device. Next, the generation unit 19*a* assigns the off-state to the refrigerant supply device again.

Note that, finally, the off-state is assigned to all of the refrigerant supply devices 12J to 12N. This case is excluded from the change patterns. Referring to FIG. 8, the off-state is finally assigned to all of the refrigerant supply devices 12J to 12N in a fourth attempt. This fourth attempt is excluded from the change patterns. Accordingly, the change patterns are patterns including three attempts.

The minimum number of attempts included in the change patterns is determined in accordance with the number of refrigerant supply devices that are subjects to be processed. More specifically, when the number of refrigerant supply devices that are subjects to be processed is denoted by n, the minimum integer N that satisfies an expression $\text{Log } 2(n+1) \leq N$ is the minimum number of attempts. For example, when the number of refrigerant supply devices is five, the minimum number of attempts is three.

Moreover, the generation unit 19*a* causes the storage section 16 to store a change-pattern set 16*f* that is a set of multiple change patterns which have been generated.

The setting unit 19*b* extracts change patterns, the number of change patterns corresponding to the number of refrigerant supply devices starting with the refrigerant supply device 12J and ending with the refrigerant supply device 12N, from the change-pattern set 16*f*. Additionally, the setting unit 19*b* associates each of the extracted change patterns to a corresponding one of the refrigerant supply devices 12J to 12N, and sets the change patterns in the change-pattern table 16*a* included in the storage section 16.

For example, as illustrated in FIG. 6, when the five refrigerant supply devices 12J to 12N exist, the setting unit 19*b* extracts five change patterns from the change-pattern set 16*f*. As illustrated in FIG. 9A, the setting unit 19*b* sets the extracted change patterns in the change-pattern table 16*a*. Here, in FIG. 9A, "1" indicates the on-state of a refrigerant supply device, and "0" indicates the off-state of a refrigerant supply device. Note that, when the number of refrigerant supply devices is three, the change-pattern table 16*a* is provided as illustrated in FIG. 9B, and, when the number of refrigerant supply devices is four, the change-pattern table 16*a* is provided as illustrated in FIG. 9C.

Note that, although change patterns that are included in the change-pattern set 16*f* and that are used for a case in which the number of refrigerant supply devices is each of three, four, and five are illustrated in a corresponding one of FIGS. 9A to 9C. However, the number of refrigerant supply devices is not limited thereto, and any number may be used as the number of refrigerant supply devices. Because change patterns that are included in the change-pattern set 16*f* and that are used for cases in which the number of refrigerant supply devices is six or more are also easily conceived from the above-described examples, illustrations and descriptions thereof are omitted.

Note that the generation unit 19*a* may not exist in the refrigeration managing apparatus 11A. In other words, the change patterns may be generated in advance by different means, and be stored as the change-pattern set 16*f* in the storage section 16. Alternatively, the change patterns may be generated in advance by a generation unit that exists outside the refrigeration managing apparatus 11A, and be stored as the change-pattern set 16*f* in the storage section 16. Furthermore, the change-pattern table 16*a* may be set in advance instated of setting the change patterns from the change-pattern set 16*f* in the change-pattern table 16*a* with the setting unit 19*b*. Alternatively, change patterns, the number of change patterns corresponding to the number of refrigerant supply devices, may be directly set in the change-pattern table 16*a* by the generation unit 19*a*.

The device control unit 19*c* performs, in accordance with the change patterns that have been set in the change-pattern table 16*a* by the setting unit 19*b*, control of making the refrigerant supply devices 12J to 12N enter the on-state/off-state in parallel so that time periods in which the refrigerant supply devices 12J to 12N are controlled overlap one another. Note that the device control unit 19*c* may perform control with direct reference to change patterns of the change-pattern set 16*f*, the number of change patterns corresponding to the number of refrigerant supply devices.

The measurement unit 19*d* measures the temperatures of the evaporators included in the showcases 13J1 to 13Nn every time when control of making the refrigerant supply devices 12J to 12N enter the on-state/off-state is performed by the device control unit 19*c*. Furthermore, the measurement unit 19*d* stores the measured temperatures in the showcase measured-temperature table 16*e*.

The analysis unit 19*e* determines the refrigerant piping groups on the basis of the temperatures, which are stored in the showcase measured-temperature table 16*e*, of the inside of the showcases 13J1 to 13Nn. A result of determination is output to the display section 15*c*.

Additionally, the storage section 16 stores the change patterns generated by the generation unit 19*a*. The change patterns set by the setting unit 19*b* are included in the change-pattern table 16*a*. The refrigerant piping groups that are to be determined in the second embodiment are included in the refrigerant-piping-group storage table 16*b*.

Various setting information items concerning the refrigerant supply devices 12J to 12N are included in the refrigerant-supply-device set table 16*c*. The cooling set temperatures of the showcases 13J1 to 13Nn are stored in the showcase set-temperature table 16*d*. The values of the temperatures of the inside of the showcases 13J1 to 13Nn that have been measured in every attempt to perform control of making the refrigerant supply devices enter the on-state/off-state in accordance with the change patterns are included in the showcase measured-temperature table 16*e*.

The signal section 15*a* performs, under control performed by the controller 19, transmission of control data to the refrigerant supply devices 12J to 12N or the cooling devices, such as the showcases 13J1 to 13Nn, and reception of measured data or the like from the cooling devices. The input section 15*b* is, for example, a touch panel, and is an interface used to input the details of an operation performed by a user. The display section 15*c* is, for example, a liquid crystal display, and displays an image under control performed by the controller 19.

3. Operation of Refrigeration Managing Apparatus

Figure 10:
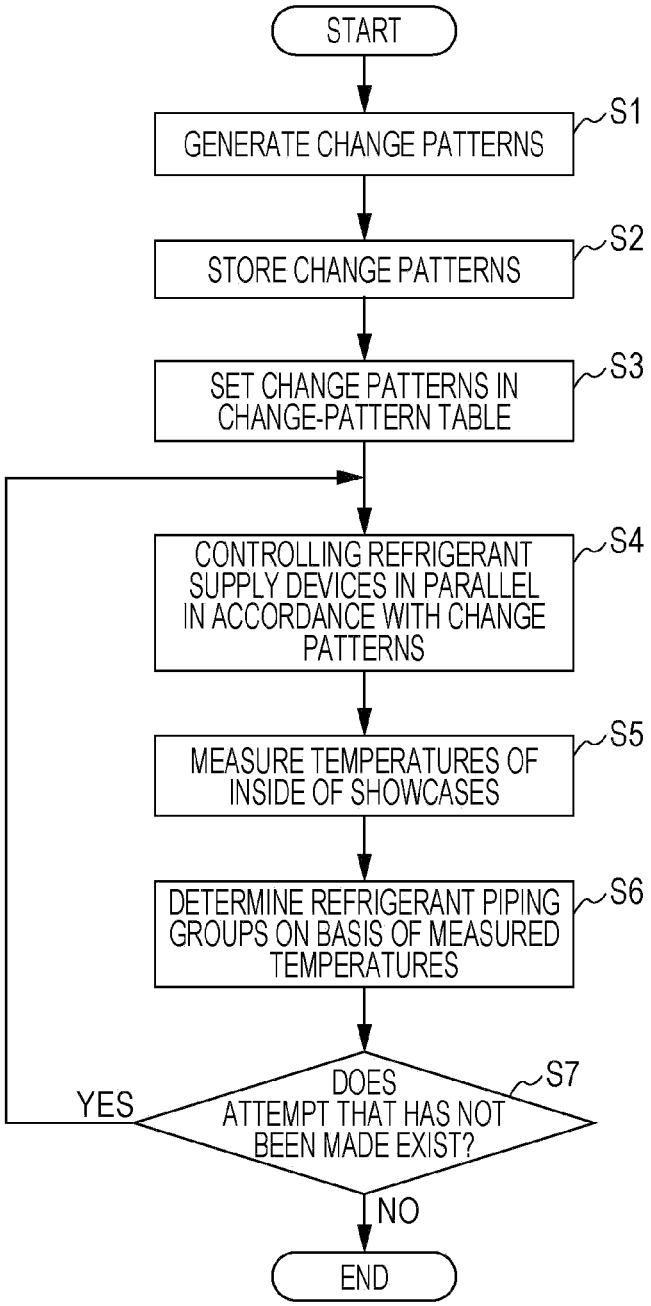
FIG. 10 is a flowchart of an operation, which is performed by the refrigeration managing apparatus according to the second embodiment, of determining refrigerant piping groups.

Next, an operation of the refrigeration managing apparatus 11A serving as an integration controller, more specifically, an operation of determining the refrigerant piping groups, will be described. FIG. 10 is a flowchart of the operation, which is performed by the refrigeration managing apparatus 11A illustrated in FIG. 6, of determining the refrigerant piping groups.

In step S1, the generation unit 19*a* included in the controller 19 generates change patterns that are patterns of the in-operation state and the stopped state of the refrigerant supply devices. In step S2, the storage section 16 stores the change-pattern set 16*f* that is a set of the change patterns generated by the generation unit 19*a*.

In step S3, the setting unit 19*b* included in the controller 19 sets the change patterns, which are stored in the storage section 16, in the change-pattern table 16*a*. In step S4, the device control unit 19*c* included in the controller 19 performs, on the basis of the number of attempts included in the change patterns that are set in the change-pattern table 16*a*, control of making the refrigerant supply devices 12J to 12N enter the on-state/off-state in parallel.

In step S5, the measurement unit 19*d* included in the controller 19 measures temperatures at places at which changes in the temperatures, which are caused by the refrigerant supply devices 12J to 12N, of the inside of the showcases 13J1 to 13Nn can be detected. In step S6, the analysis unit 19*e* included in the controller 19 determines the refrigerant piping groups on the basis of the measured temperatures (an attempt result).

More specifically, regarding each of the temperatures measured in the showcases 13J1 to 13Nn in the present attempt and the attempts previous thereto, the analysis unit 19*e* determines whether or not the temperature is in a predetermined range (a first temperature range) mainly including temperatures in a case of non-cooling, and whether or not the temperature is in a predetermined range (a second temperature range) mainly including the cooling set temperatures that are included in the showcase set-temperature table 16*d*.

Next, regarding each of the temperatures measured in the showcases 13J1 to 13Nn in the present attempt and the attempts previous thereto, the analysis unit 19*e* assigns 0 when the temperature is in the first temperature range, and assigns 1 when the temperature is in the second temperature range, thereby generating a temperature transition. Next, the analysis unit 19*e* compares the temperature transition with each of transitions between the on-state and the off-state (on-state-off-state transitions) used in the present attempt and the attempts previous thereto among transitions between the on-state and the off-state included in the change patterns that are patterns of the on-state and the off-state of the refrigerant supply devices 12J to 12N. Furthermore, only when the number of on-state-off-state transitions that coincide with the temperature transition is one, does the analysis unit 19*e* determine that the showcase corresponding to the temperature transition is connected to the refrigerant supply device corresponding to the on-state-off-state transition.

Note that the analysis unit 19*e* may assign values corresponding to changes in the temperature, more specifically, may assign 0 when the temperature increases, assign 1 when the temperature decreases, and assign a value that is the same as the immediately previous value when the temperature does not change, thereby generating a temperature transition. Also on the basis of the temperature transition, the analysis unit 19*e* can determine the refrigerant piping groups. In this case, in order to generate a temperature transition, the analysis unit 19*e* does not need to wait until each of the temperatures of the showcases 13J1 to 13Nn reaches the first temperature range or the second temperature range. Accordingly, the analysis unit 19*e* can determine the refrigerant piping groups at an earlier stage.

In step S7, the controller 19 determines whether or not, among the attempts included in the change patterns, an attempt that has not been made exists. When an attempt that has not been made exists, the operation of performing control of making the refrigerant supply devices enter the on-state/off-state in parallel in accordance with the change patterns in step S4 and the operations thereafter are repeated. When an attempt that has not been made does not exist, the series of operations finishes.

4. Advantages

In the second embodiment, the refrigeration managing apparatus 11A generates change patterns that include the minimum number, which is determined in accordance with the number of refrigerant supply devices, of attempts to make the refrigerant supply devices enter the on-state/off-state and that are patterns of the on-state and the off-state of the refrigerant supply devices. The refrigeration managing apparatus 11A sets a change pattern among the change patterns for each of the refrigerant supply devices so that the change pattern is different from any one of the change patterns set for the other refrigerant supply devices. Furthermore, the refrigeration managing apparatus 11A controls the individual refrigerant supply devices in parallel in accordance with the set change patterns.

With the refrigeration managing apparatus 11A, the number of attempts to make the individual refrigerant supply devices enter the on-state/off-state is minimized, and control of making the individual refrigerant supply devices enter the on-state/off-state in parallel is performed, whereby the time taken to determine the refrigerant piping groups can be reduced.

Furthermore, change patterns in which all of the refrigerant supply devices are made to enter the off-state do not exist. Accordingly, the temperatures of the inside of the showcases can be reduced by operating each of the refrigerant supply devices 12 at least once. In other words, a showcase whose temperature does not decrease because the showcase is not connected to any one of the refrigerant supply devices due to an implementation mistake or the like can be found.

Other Embodiments

The foregoing first and second embodiments of the present disclosure are described. However, it should be understood that the description and the drawings which constitute a part of this disclosure do not limit the present invention. Those skilled in the art can conceive various alternative embodiments, examples, and operational techniques from this disclosure.

For example, in the foregoing first and second embodiments, one refrigerant piping group is formed by connecting multiple cooling devices in parallel to one refrigerant supply device via a refrigerant pipe. However, one refrigerant piping group may be formed by connecting one cooling device to one refrigerant supply device via a refrigerant pipe.

Furthermore, for example, the refrigerant supply devices and the showcases may be divided into a group of refrigerant supply devices and showcases that are used for chilling and a group of refrigerant supply devices and showcases that are used for freezing, and the groups correspond to a set temperature range for freezing and a set temperature range for chilling or correspond to device type information items indicating whether the refrigerant supply devices are used for freezing or cooling. In this case, the generation unit 19*a* included in the controller 19 of the refrigeration managing apparatus 11A may generate change patterns for chilling for the group to which the refrigerant supply devices used for chilling belong, and generate change patterns for freezing for the group to which the refrigerant supply device used for freezing belong. In this case, the number of refrigerant supply devices belong to each of the groups is smaller than the total number of refrigerant supply devices. Accordingly, the number of attempts included in the generated patterns for chilling and freezing can be reduced.

For example, when, among the five refrigerant supply devices 12J to 12N, the refrigerant supply devices 12J to 12L are used for chilling and the refrigerant supply devices 12M and 12N are used for freezing, a change-pattern table for chilling corresponding to the refrigerant supply devices 12J to 12L is provided as illustrated in FIG. 11A, and a change-pattern table for freezing corresponding to the refrigerant supply devices 12M and 12N is provided as illustrated in FIG. 11B. The number of attempts is reduced, so that the number of attempts is one smaller than the number of attempts included in the change patterns illustrated in FIG. 8.

In other words, chilling set temperatures, which are cooling set temperatures for a case of chilling, and freezing set temperatures, which are cooling set temperatures for a case of freezing, are different from each other. Even when one of the refrigerant supply devices belonging to the group for chilling and one of the refrigerant supply devices belonging to the group for freezing are controlled in parallel in accordance with the same change pattern, refrigerant piping groups can be determined. Accordingly, the number of attempts can be reduced, so that the number of attempts can be smaller than the number of attempts in a case in which each of the refrigerant supply devices is controlled in accordance with a change pattern different from any one of change patterns that are set for the other refrigerant supply devices.

Additionally, the device control unit 19*c* included in the controller 19 can control the refrigerant supply devices included in the two groups in parallel in accordance with the change patterns for chilling for the group to which the refrigerant supply devices used for chilling belong and in accordance with the change patterns for freezing for the group to which the refrigerant supply devices used for freezing belong. Accordingly, the time taken to determine the refrigerant piping groups can be reduced.

After that, in a case of determining the refrigerant piping groups, the analysis unit 19*e* performs processes given below. More specifically, regarding each of the temperatures measured in the showcases 13J1 to 13Nn in the present attempt and the attempts previous thereto, the analysis unit 19*e* determines whether or not the temperature is in a predetermined range (a first temperature range) mainly including temperatures in a case of non-cooling, whether or not the temperature is in a predetermined range (a second temperature range) mainly including the chilling set temperatures that are included in the showcase set-temperature table 16*d*, and whether or not the temperature is in a predetermined range (a third temperature range) mainly including the freezing set temperatures that are included in the showcase set-temperature table 16*d*.

Next, regarding each of the temperatures measured in the showcases 13J1 to 13Nn in the present attempt and the attempts previous thereto, the analysis unit 19*e* assigns 0 when the temperature is in the first temperature range, and assigns 1 when the temperature is in the second temperature range, thereby generating a chilling temperature transition. In addition, the analysis unit 19*e* assigns 0 when the temperature is in the first temperature range, and assigns 1 when the temperature is in the third temperature range, thereby generating a freezing temperature transition.

Next, the analysis unit 19*e* compares the chilling temperature transition with each of the on-state-off-state transitions used in the present attempt and the attempts previous thereto among transitions between the on-state and the off-state included in the change patterns for chilling. Furthermore, only when the number of on-state-and-off-state transitions that coincide with the chilling temperature transition is one, does the controller 19 determine that the showcase corresponding to the chilling temperature transition is connected to the refrigerant supply device corresponding to the on-state-and-off-state transition. Similarly, the analysis unit 19*e* compares the freezing temperature transition with each of the on-state-off-state transitions used in the present attempt and the attempts previous thereto among transitions between the on-state and the off-state included in the change patterns for freezing. Furthermore, only when the number of on-state-and-off-state transitions that coincide with the freezing temperature transition is one, does the controller 19 determine that the showcase corresponding to the freezing temperature transition is connected to the refrigerant supply device corresponding to the on-state-and-off-state transition.

Although a specific form of embodiment of the instant invention has been described above and illustrated in the accompanying drawings in order to be more clearly understood, the above description is made by way of example and not as a limitation to the scope of the instant invention. It is contemplated that various modifications apparent to one of ordinary skill in the art could be made without departing from the scope of the invention which is to be determined by the following claims.

What is claimed is:

1. A refrigeration managing apparatus for controlling operation of refrigeration cycles of refrigerant piping groups installed in a single store, and for determining connection relationships of refrigerant pipes connected between refrigerant supply devices and cooling devices included in the refrigerant piping groups, each of the refrigerant piping groups comprising:

a cooling device that has an evaporator that cools a subject, and a refrigerant supply device that has a refrigerant compressor and supplies a refrigerant to the cooling device, wherein each of the refrigeration cycles are formed for a corresponding group of the refrigerant piping groups by connecting the refrigerant compressor of the refrigerant supply device, a condenser, a decompressor, and the evaporator of the cooling device in a loop using a refrigerant pipe, the refrigeration managing apparatus comprising:

a storage section that stores parallel change patterns, wherein multiple refrigerant supply devices simultaneously enter an in-operation state, which parallel change patterns are determined on the basis of the number of refrigerant supply devices and in which states of the refrigerant supply devices are changed with time in parallel by being simultaneously switched between an in-operation state and a stopped state; and a controller that detects changes in temperatures of the evaporators of the cooling devices when the refrigerant supply devices are operated and/or stopped simultaneously in accordance with the parallel change patterns stored in the storage section, and that determine, among the cooling devices, a cooling device having an evaporator whose temperature changes in synchronization with the in-operation and/or stopped state of a refrigerant supply device among the refrigerant supply devices is connected to the refrigerant supply device using the corresponding refrigerant pipe, wherein the parallel change patterns are patterns including the minimum number of attempts to operate and/or stop the refrigerant supply devices, the minimum number of attempts being determined in accordance with the number of refrigerant supply devices, and wherein the controller comprises:

a device control unit that controls the refrigerant supply devices simultaneously in parallel with reference to the parallel change patterns, the number of parallel change patterns corresponding to the number of refrigerant supply devices, among the parallel change patterns stored in the storage section, a measurement unit that measures the temperatures of the evaporators included in the cooling devices, and an analysis unit that determines the refrigerant piping groups on the basis of the temperatures, which have been measured by the measurement unit, of the evaporators included in the cooling devices.

2. The refrigeration managing apparatus according to claim 1, further comprising a signal processor that assigns addresses to the cooling devices in an order in which changes in the temperatures of the evaporators of the cooling devices are detected when the refrigerant supply devices are operated and/or stopped in accordance with the parallel change patterns stored in the storage section.

3. The refrigeration managing apparatus according to claim 2, wherein the signal processor assigns addresses to the cooling devices in an order in which the temperatures of the evaporators of the cooling devices decrease by a predetermined amount or more.

4. The refrigeration managing apparatus according to claim 1, further comprising a generation section that generates the parallel change patterns.

5. The refrigeration managing apparatus according to claim 4, wherein the generation section divides the refrigerant supply devices into two groups, repeatedly performs a grouping process of further dividing each of the two groups into two groups until grouping is no longer able to be performed, and generates parallel change patterns in which the in-operation state of the refrigerant supply devices is assigned to one of the two groups which are generated every time the grouping process is performed, and in which the stopped state of the refrigerant supply devices is assigned to the other group.

6. The refrigeration managing apparatus according to claim 4, wherein the generation section generates parallel change patterns in which each of the refrigerant supply devices is operated at least once.

7. The refrigeration managing apparatus according to claim 1, wherein, in a case in which the refrigerant supply devices are divided into groups corresponding to set temperature ranges or device type information items, the device control unit controls the refrigerant supply devices belonging to the groups in parallel with reference to the parallel change patterns, the number of the parallel change patterns corresponding to the number of refrigerant supply devices included in the groups, among the parallel change patterns stored in the storage section.

* * * * *